US009464557B2

(12) United States Patent
Hornby et al.

(10) Patent No.: US 9,464,557 B2
(45) Date of Patent: Oct. 11, 2016

(54) MUFFLER SHIELD AND MUFFLER ASSEMBLY EMPLOYING THE SAME

(71) Applicant: FORD GLOBAL TECHNOLOGIES, LLC, Dearborn, MI (US)

(72) Inventors: Steven Allen Hornby, Ypsilanti, MI (US); Erich James Nowka, Ann Arbor, MI (US); Kerry Timothy Havener, Canton, MI (US)

(73) Assignee: FORD GLOBAL TECHNOLOGIES, LLC, Dearborn, MI (US)

( * ) Notice: Subject to any disclaimer, the term of this patent is extended or adjusted under 35 U.S.C. 154(b) by 0 days.

(21) Appl. No.: 14/549,188

(22) Filed: Nov. 20, 2014

(65) Prior Publication Data

US 2016/0146087 A1 May 26, 2016

(51) Int. Cl.
*F01N 13/00* (2010.01)

(52) U.S. Cl.
CPC ..... *F01N 13/00* (2013.01); *F01N 2260/00* (2013.01); *F01N 2260/18* (2013.01); *F01N 2260/20* (2013.01); *F01N 2510/00* (2013.01)

(58) Field of Classification Search
CPC .... F01N 2260/20; F01N 13/08; F01N 13/14; F01N 13/141
USPC ..... 181/282, 283
See application file for complete search history.

(56) References Cited

U.S. PATENT DOCUMENTS 3,237,716 A * 3/1966 Parsons ..... F01N 13/14 138/178
4,478,310 A * 10/1984 Harter ..... F01N 13/14 126/83
4,609,067 A * 9/1986 Gonwa ..... F01N 13/14 126/83
5,036,947 A * 8/1991 Metzger ..... F01N 13/14 181/211
5,211,013 A 5/1993 Bonde et al.
5,281,778 A * 1/1994 Cheladyn ..... F01N 13/14 181/211
5,474,123 A * 12/1995 Buckshaw ..... F28F 19/002 138/110
5,482,681 A * 1/1996 Sager, Jr. ..... F01N 3/2857 422/177
6,438,949 B1 * 8/2002 Nozaki ..... B60K 13/04 123/184.21
6,575,267 B1 * 6/2003 Stiles ..... F01N 13/00 181/243
7,320,299 B2 * 1/2008 Eavenson, Sr. ..... F01N 13/082 123/41.49

(Continued)

FOREIGN PATENT DOCUMENTS

CN 202391535 8/2012

OTHER PUBLICATIONS

Harley-Davidson Motor Company—Sportster Exhaust Heat Shields—Instructions—J04876, Rev. Mar. 21, 2013, two pages.

*Primary Examiner* — Jeremy Luks

(74) *Attorney, Agent, or Firm* — Gregory P. Brown; Law Firm of Dr. Junqi Hang, PLC

(57) ABSTRACT

In one or more embodiments, a muffler shield includes a shield body extending in a longitudinal direction and defining a middle portion positioned between first and second side portions along a transverse direction, a cross-section of the middle portion and at least one of the first and second side portions respectively defining a middle profile and a side profile shorter than the middle profile.

8 Claims, 4 Drawing Sheets

(56) References Cited

U.S. PATENT DOCUMENTS

| | | | | |
|---|---|---|---|---|
| 7,946,380 | B2 * | 5/2011 | Yamamoto | F01N 13/14 181/204 |
| 8,011,471 | B2 * | 9/2011 | Zheng | F01N 1/003 181/265 |
| 8,028,795 | B2 * | 10/2011 | Hisanaga | F01N 13/141 181/204 |
| 8,602,158 | B2 * | 12/2013 | Hayama | F01N 13/14 181/212 |
| 8,701,824 | B2 * | 4/2014 | Hayama | F01N 3/2885 181/228 |
| 2004/0083714 | A1 | 5/2004 | Tsuruta | |
| 2006/0000668 | A1 * | 1/2006 | Yamaguchi | F01N 1/084 181/249 |
| 2006/0065480 | A1 | 3/2006 | Leehaug | |
| 2008/0098721 | A1 | 5/2008 | Liu | |
| 2008/0296878 | A1 | 12/2008 | Pruit | |
| 2011/0278881 | A1 * | 11/2011 | Asai | B60K 13/04 296/193.07 |

* cited by examiner

MUFFLER SHIELD AND MUFFLER ASSEMBLY EMPLOYING THE SAME

TECHNICAL FIELD

The disclosed inventive concept relates generally to a muffler shield and a muffler assembly employing the same.

BACKGROUND

Vehicle exhaust systems often include various exhaust components for treating exhaust gases. A typical exhaust system includes an exhaust pipe directing exhaust gases from an internal combustion engine to a muffler, and a tail pipe guiding the exhaust gases from the muffler to atmospheric air. In addition to guiding exhaust gases, the muffler is also designed to reduce operational noises associated with the engine and exhaust system.

Although functionally useful as indicated herein above, mufflers are often positioned underneath the vehicle body for certain structural and/or mechanical considerations. Because of its under-body position, mufflers may encounter aerodynamic resistance due to wind and speed when the vehicle is in motion.

SUMMARY

In one or more embodiments, the present invention provides a muffler shield including a shield body extending in a longitudinal direction and defining a middle portion positioned between first and second side portions along a transverse direction, a cross-section of the middle portion and at least one of the first and second side portions respectively defining a middle profile and a side profile shorter than the middle profile.

In another or more embodiments, the present invention provides a muffler assembly, including a muffler extending in a longitudinal direction, and a muffler shield supported on the muffler and defining a middle portion positioned between first and second side portions along a transverse direction, a cross-section of the middle portion and of at least one of the first and second side portions respectively defining a middle profile and a side profile shorter than the middle profile.

In yet another or more embodiments, the present invention further provides a muffler assembly, including a muffler including an exterior surface, a muffler shield supported on the exterior surface of the muffler and extending in a longitudinal direction, the muffler shield defining a middle portion positioned between first and second side portions along a transverse direction, the middle and first and second side portions defining a middle profile, a first and second side profiled relative to exterior surface of the muffler, the middle profile being greater than at least one of the first and second side profiles.

The above advantages and other advantages and features will be readily apparent from the following detailed description of embodiments when taken in connection with the accompanying drawings.

BRIEF DESCRIPTION OF THE DRAWINGS

For a more complete understanding of embodiments of this invention, reference should now be made to the embodiments illustrated in greater detail in the accompanying drawings and described below by way of examples wherein.

DETAILED DESCRIPTION OF ONE OR MORE EMBODIMENTS

Figure 1:
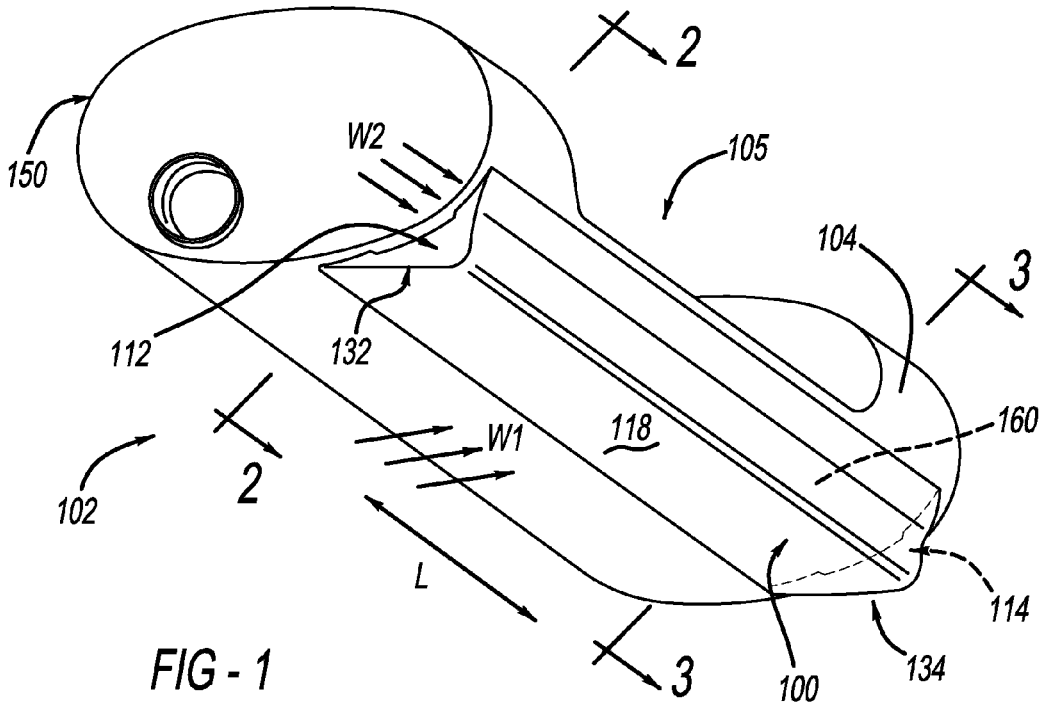
FIG. 1 illustratively depicts a perspective view of a muffler assembly in one or more embodiments.

As referenced in the FIG. 1 through FIG. 3F, the same reference numerals are used to refer to the same components. In the following description, various operating parameters and components are described for different constructed embodiments. These specific parameters and components are included as examples and are not meant to be limiting.

As is detailed herein elsewhere, the present invention in one or more embodiments is believed to be advantageous in being reflective of a discovery on the significance of an air gap between a muffler and a shield thereupon and on the benefit of reducing aerodynamic turbulence associated with the air gap. In particular, the aerodynamic performance is believed to be enhanced when air flow turbulence is reduced at locations where the shield comes to close interaction or contact with the muffler. More particularly, the reduction in air flow turbulence is believed to be realized when such locations are substantially free or entirely free of mechanical connectors, with non-limiting examples thereof including nails, nuts, bolts and threaded fasteners in any shape or form.

Figure 2:
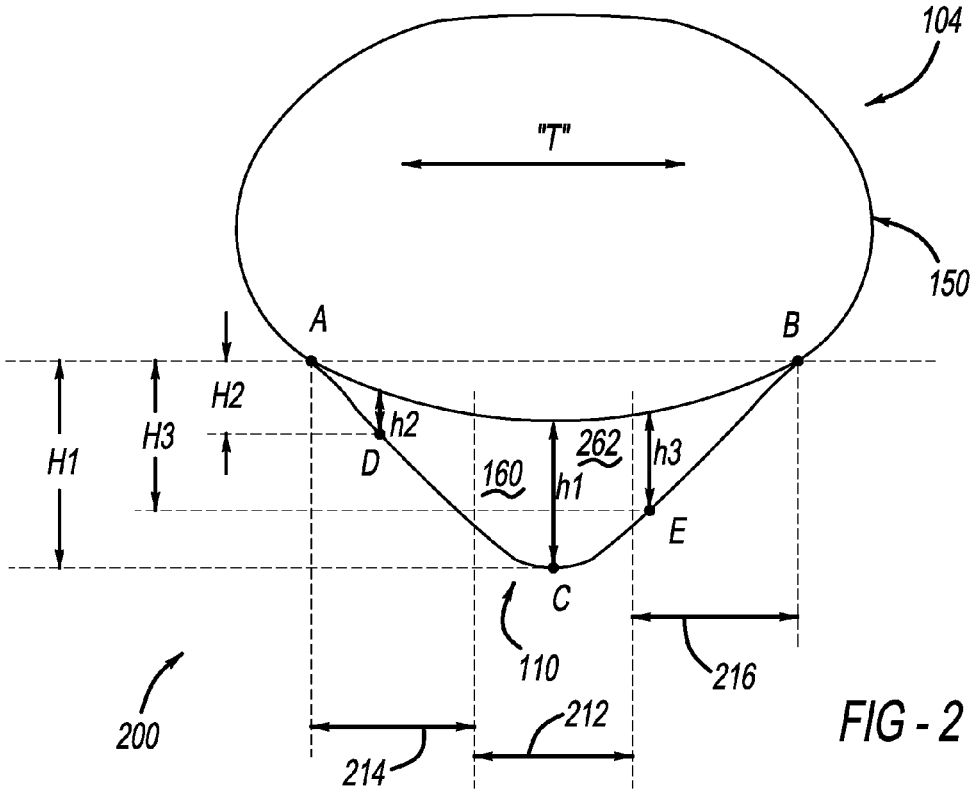
FIG. 2 illustratively depicts a cross-sectional view of the muffler assembly referenced in FIG. 1.

In one or more embodiments, and as illustratively depicted in FIG. 1 in view of FIG. 2, a muffler assembly generally shown at 102 includes a muffler 104 and a muffler shield 100 attached to the muffler 104. The muffler shield 100 includes a shield body 118 extending in a longitudinal direction "L," which in turn includes a middle portion 212 positioned between first and second side portions 214, 216 along a transverse direction "T," a cross-section of the middle portion 212 and at least one of the first and second side portions 214, 216 respectively defining a middle profile "H1" and a side profile "H2" or "H3" shorter than the middle profile "H1."

Further in view of FIG. 2, the middle profile "H1" is defined as a linear vertical distance of point "C" on the shield body 118 at cross-section 200 away from line "AB", where the line "AB" is in turn defined by two end points "A" and "B" of the shield body 118 at cross-section 200. In certain particular embodiments, one or both of the points "A" and "B" are where the shield body 118 comes to contact the muffler 104 at the cross-section 200.

Further in view of FIG. 2, the first side profile "H2" is defined as a linear vertical distance of point "D" on the shield body 118 at the cross-section 200 away from the line "AB." The point "D" may be any point positioned between the point "A" of the first side portion 214 and the point "C" of the middle portion 212 at the cross-section 200.

Further in view of FIG. 2, the second side profile "H3" is defined as a linear vertical distance of point "E" on the shield body 118 at cross-section 200 away from the line "AB." The point "E" may be any point positioned between the point "B" of the first side portion 214 and the point "C" of the middle portion 212 at the cross-section 200.

Referring back to FIG. 2, the middle portion 212 may be of any suitable dimension along the transverse direction "T" at the cross-section 200 in comparison to the first and second side portions 214, 216, as long as the middle portion 212 include the point "C" which is farthest away from the line "AB" in comparison to all other points on the shield body 118 at the cross-section 200. Accordingly, another cross-section (not shown) of the shield body 118 spaced apart from the cross-section 200 along the longitudinal direction "L" may be spaced apart from the point "C" along the transverse direction "T." Accordingly also, the middle portion 212 includes the point "C" and all its counterparts positioned on all other cross-sections sequentially positioned along the longitudinal direction "L." Accordingly further, the middle portion 212 may be presented with uneven surface shapes due to the fact that the point "C" and all its counterparts may be positioned spaced apart from one and another along the transverse direction "T."

The width of the line "AB" along the transverse direction "T" may be of any suitable values and may vary dependent upon an outer shape of the muffler 104. In certain particular embodiments, the line "AB" is coordinated in value with the position of the point "C" such that an angle "BCA" defined by line "CA" and line "CB" is greater than 90 degrees and smaller than 180 degrees. This angle design may be beneficial to provide a relatively smoother surface to lead an incoming air flow.

The middle profile "H1" is longer than any one of the first and second side profiles "H2" and "H3;" this is at least because the middle profile "H1" defines the point on the shield body 118 at any given cross-section that is farthest away from line "AB." The first and second side profiles "H2" and "H3" may be the same or different in value.

The profiles "H1", "H2" and "H3" may alternatively be referred to as profiles "h1", "h2" and "h3", with the latter ones defined as linear distances defined between the points "C", "D" and "E" relative to the exterior surface 150 of the muffler 104, along the same directions by which the profiles "H1", "H2" and "H3" are defined, respectively. In instances where any parts of the exterior surface 150 between points "A" and "B" bend inwardly toward a center of the muffler 104, the profiles "h1", "h2" and "h3" may each be independently greater than the profiles "H1", "H2" and "H3", respectively.

The shield body 118 may be made of any suitable materials, and may include a metallic material in certain embodiments with non-limiting examples thereof including iron, copper, and a metal oxide of iron or copper. One particular benefit of using a metallic material in forming the shield body 118 may be that the thus formed shield body 118 may be resilient enough to closely align with or directly contact the muffler 104 particularly at the first and/or second side portions 214, 216. Accordingly at least a part of the first and/or second side portions and particularly the corresponding leading edge thereof does not necessarily require additional fasteners or connectors due to the presence of the resilient force exerted by the resilient material in combination with the profile differential between "H1" as opposed to "H2" and/or "H3."

Optionally, the closeness of at least a part of the first and/or second side portions 214, 216 and particularly the corresponding leading edge thereof relative to the muffler 104 may further be enhanced by the use of non-mechanical connectors such as adhesives and heat-assisted soldering.

In certain embodiments, the muffler shield 110 further includes at least one of first and second end covers 112, 114 as illustratively depicted in FIG. 1. As illustratively depicted in FIG. 1, the muffler 104 may include a middle recess 105 to be positioned between the first and second end covers 112, 114. The first end cover 112 and/or the second end cover 114 are each positioned to provide a closure respectively at first and second ends 132, 134 of the shield body 118 to fend off unwanted debris such as dust, rocks, rain or incoming wind which may get trapped between the muffler 104 and the shield body 118 and thereafter cause unnecessary rattle and noise. The first and second end covers 112, 114 are particularly beneficial due to the unique cross-sectional shape of the shield body 118, which imparts a relatively more prominent middle elevation as mentioned herein elsewhere and hence relatively higher tendency to catch the unwanted debris in certain driving conditions. With the employment of the first and/or second end covers 112, 114, the muffler shield 110 is positioned with relatively reduced rattle creation due to air movement not only in a direction generally shown at "W1" but also in a direction generally shown at "W2."

In addition, the first and/or the second end covers 112, 114 may include or be formed of relatively sturdy or rigid material so as to provide additional structural support to the muffler shield 110 and to help prevent the shield body 118 from collapsing down to the exterior surface 150 of the muffler 104.

Although the presence of the first and/or second end covers 112, 114 may be beneficial to reduce air-induced and/or mechanical vibration-induced rattle in some instances, the presence of one or both of the first and second end covers 112, 114 may not be required in others dependent upon a particular shape, design or under-body positioning of the muffler 104 itself.

When employed, the first and second end covers 112, 114 may each be independently pre-formed and thereafter attached to the shield body 118 to form the muffler shield 110. Optionally also, the first and/or second end covers 112, 114 may be formed as integral extension from the shield body 118.

Figure 5:
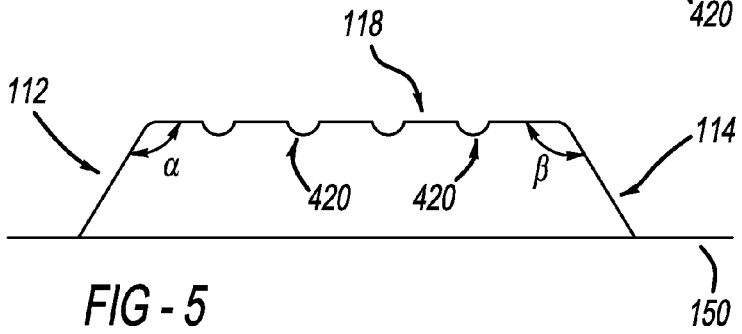
FIG. 5 illustratively depicts an alternative cross-sectional view of the muffler assembly referenced in FIG. 1 or FIG. 4.

In certain embodiments, and as illustratively depicted in FIG. 5, one or both of the first and second end covers 112, 114 may be positioned relative to the shield body 118 with an angle $\alpha$ and an angle $\beta$, respectively, where at least one of the angles $\alpha$ and $\beta$ is greater than 90 degrees. This configuration may be particularly beneficial for avoiding any unnecessary resistance to an incoming air flow.

In certain embodiments, the first end cover 112 and/or the second end cover 114 may at least partially contact any one of the first side portion 214, the middle portion 212, the second side portion 216, and an exterior surface 150 of the muffler 104.

In certain embodiments, the muffler shield 110 defines there-within a cavity 160 along with the exterior surface 150 of the muffler 104. This is beneficial to reduce unnecessary weight of the muffler shield 110 particularly when the muffler shield 110 is for under-body mount as illustratively depicted in FIG. 1. For the non-limiting consideration of further reducing air-induced rattle and/or mechanical vibration-induced rattle, a filler (not shown) may be placed in any open spaced allotted within the cavity 160. The filler is optionally light-weight and relatively heat resistant, and may be of any suitable material, with non-limiting examples thereof including plastic threads, carbon threads, and metallic threads, which tend to possess relatively higher volume-to-weight ratios. When employed, the filler is believed to provide cushion between the relatively rigid construction of the muffler shield 100 relative to the exterior surface 150 of the muffler 104. In addition, the open spaces or the pores defined within the filler due to the relatively large volume-to-weight ratios further helps absorb or trap air pockets and hence noise.

As mentioned herein elsewhere, one of the considerations in reducing air-induced rattle and/or mechanical vibration-induced rattle is to reduce or eliminate the presence of any mechanical fasteners at the first and/or second side portions 214, 216. Accordingly one or more fasteners may be positioned at the middle portion 212 to provide added connective force for the muffler shield 110 to adhere well to the muffler 104. Because of the elevation of the middle portion 212 relative to the exterior surface 150 of the muffler 104, the one or more fasteners are designed and positioned to accommodate the elevation while providing the connective force.

Figure 3A:
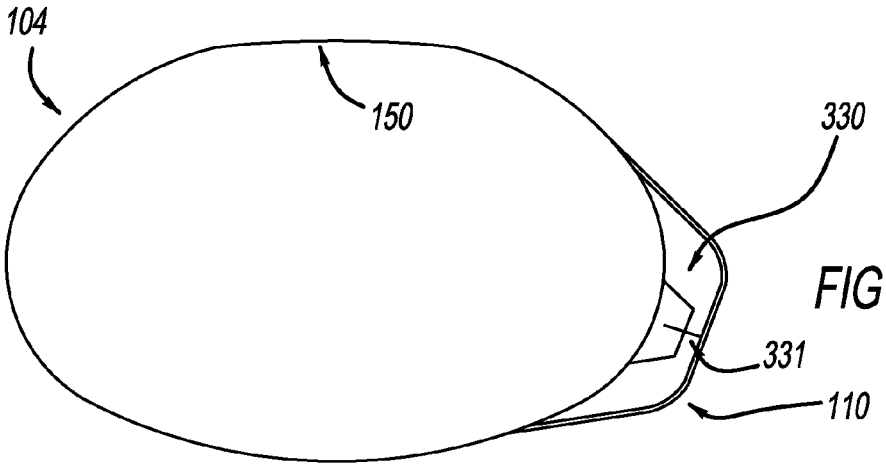
FIG. 3A illustratively depicts another cross-sectional view of the muffler assembly referenced in FIG. 1.

As illustratively depicted in FIG. 3A, which is a cross-section of the muffler assembly 100 referenced in FIG. 1 taken along line 3-3, where the muffler shield 110 is shown as mounted onto the exterior surface 150 of the muffler 104 by a stand-off connector 330 and a threaded fastener 331 engaged with the stand-off connector 330. The stand-off connector 330 and the threaded fastener 331 may each of any suitable shape and be formed of any suitable material. One consideration is that the stand-off connector 330, when working in concert with the threaded fastener 331, provides a connective force for that the attachment of the muffler shield 110 onto the muffler 104 and concurrently functions as an elevation spacer for maintaining the general configuration of the muffler shield 100. More than one pair of the stand-off connector 330 and the threaded fastener 331 may be employed along the longitudinal direction "L" and/or along the transverse direction "T" within the middle portion 212. The stand-off connector 330 may be welded onto or stamped into the exterior surface 150 of the muffler 104.

Figure 3B:
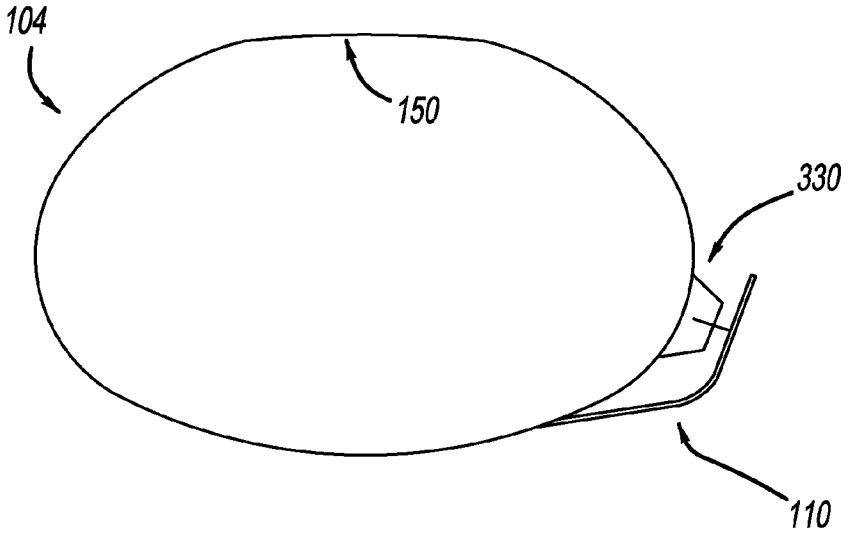
FIG. 3B illustratively depicts yet another cross-sectional view of the muffler assembly referenced in FIG. 1.

FIG. 3B illustratively depicts a cross-sectional view of a variation to the muffler assembly 102 referenced in FIG. 1, where at least a part of the second side portion 216 is omitted under certain instances, and where the connector-fastener arrange is similar to the one illustratively depicted in FIG. 3A. The configuration here may be particularly beneficial in instances due to the weight or the shape of the muffler shield 100, and/or any particular design of the muffler 104 at hand.

Figure 3C:
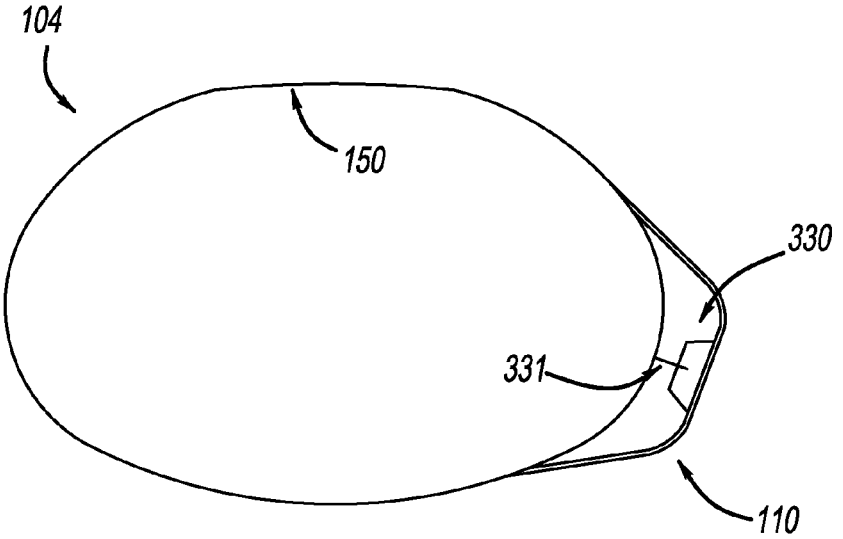
FIG. 3C illustratively depicts yet another cross-sectional view of the muffler assembly referenced in FIG. 1.

FIG. 3C illustratively depicts another alternative cross-sectional view of the muffler assembly 102 referenced in FIG. 1 taken along line 3-3, where the stand-off connector 330 is shown to be positioned onto the middle portion 214 of the muffler shield 110 and the threaded connector 331 is instead connected to the exterior surface 150 of the muffler 104. Essentially the configuration of the connector-fastener pair shown in FIG. 3C presents a reverse arrangement relative to what is depicted in FIG. 3A. For certain considerations, such as the consideration of more effectively utilizing the space available from the cavity 160, one or more of the connector-fastener pairs shown in FIG. 3A and one or more of the connector-fastener pairs shown in FIG. 3C may be concurrently employed in a single muffler assembly 102.

Figure 3D:
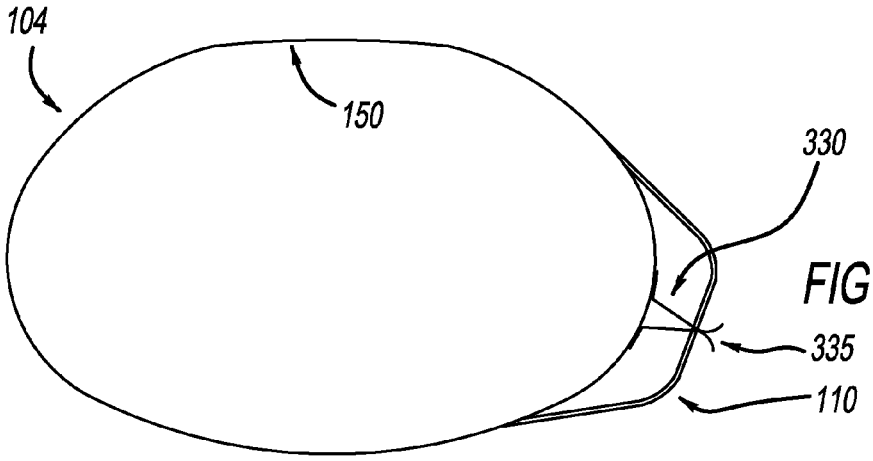
FIG. 3D illustratively depicts yet another cross-sectional view of the muffler assembly referenced in FIG. 1.

FIG. 3D illustratively depicts an alternative cross-sectional view of the muffler assembly 102 referenced in FIG. 1 taken along line 3-3, where the stand-off connector 330 is used alone without the threaded fastener 331. As illustratively depicted in FIG. 3D, the stand-off connector 330 may sit on or through the exterior surface 150 of the muffler 104 and be configured with an end point 335 piercing through and thus be connected to the middle portion 212 of the muffler shield 110. Once piercing through the middle portion 212, the end point 335 may be bent down towards an exterior surface of the middle portion 212 to provided added connection. Similar to what is mentioned in relation to FIG. 3A, the stand-off connector 330 may be attached to the muffler 104 via any suitable methods involving the use of adhesives, screws or heat-assisted welding. From the view point of only one piece of connector may be needed for attachment, relatively enhanced cost and labor efficiency may be provided to the configuration shown in FIG. 3D.

Figure 3E:
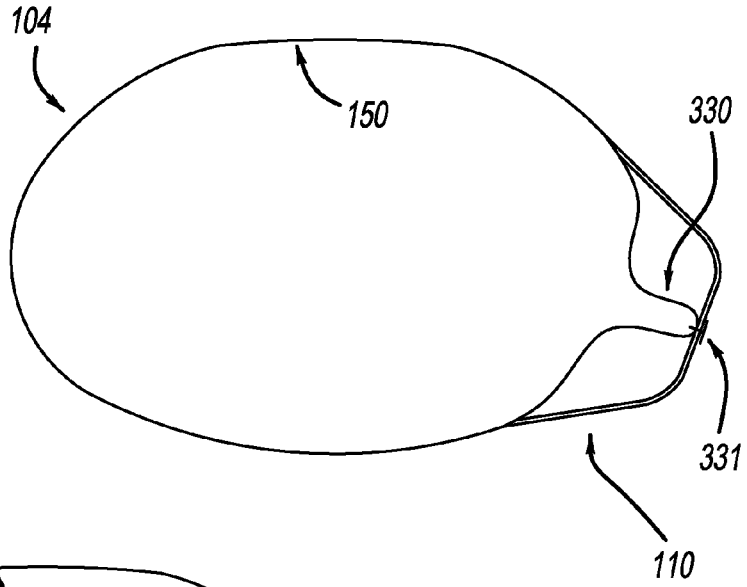
FIG. 3E illustratively depicts yet another cross-sectional view of the muffler assembly referenced in FIG. 1.

FIG. 3E illustratively depicts another alternative cross-sectional view of the muffler assembly 102 referenced in FIG. 1 taken along line 3-3, where the stand-off connector 330 is shown to be an integral part of the muffler 104 or the exterior surface 150 thereof. Similar to what is depicted in FIG. 3A, one or more threaded fasteners 331 may be used to secure the attachment between the stand-off connector 330 and hence the muffler 104 to the muffler shield 100. This configuration may be particularly beneficial where the muffler 104 is of certain material or configuration where attachment thereto of one of more of the stand-off connectors 330 may be feasible in certain instances.

Figure 3F:
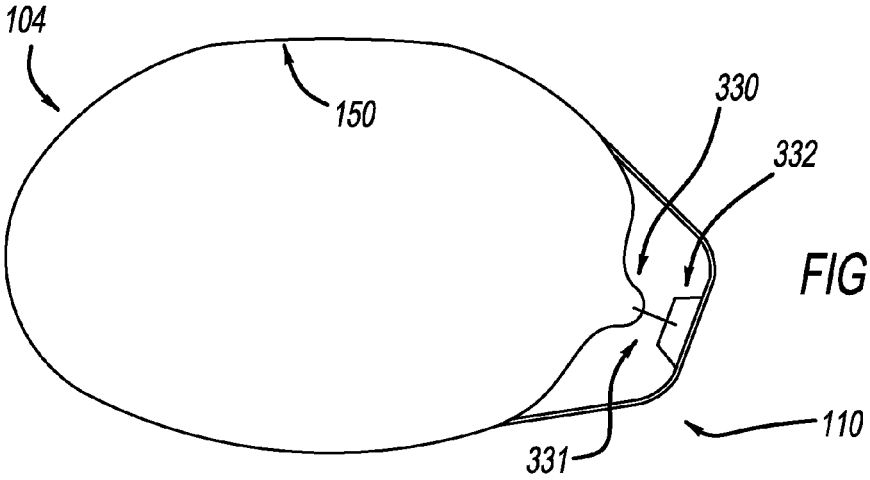
FIG. 3F illustratively depicts yet another cross-sectional view of the muffler assembly referenced in FIG. 1.

FIG. 3F illustratively depicts an alternative cross-sectional view of the muffler assembly 102 referenced in FIG. 1 taken along line 3-3, which combines the configurations shown in FIG. 3C and FIG. 3E. This arrangement of the stand-off connector 330 coupled with a second stand-off connector 332 and the threaded fastener 331 is believed to advantageous in supporting the attachment of the muffler shield 100 to the muffler 104 wherein the middle profile "H1" of the middle portion 212 of the muffler shield 100 may be of a particularly greater value and where a single stand-off connector may not be sturdy enough or be of big enough in profile value to provide the support.

Figure 6:
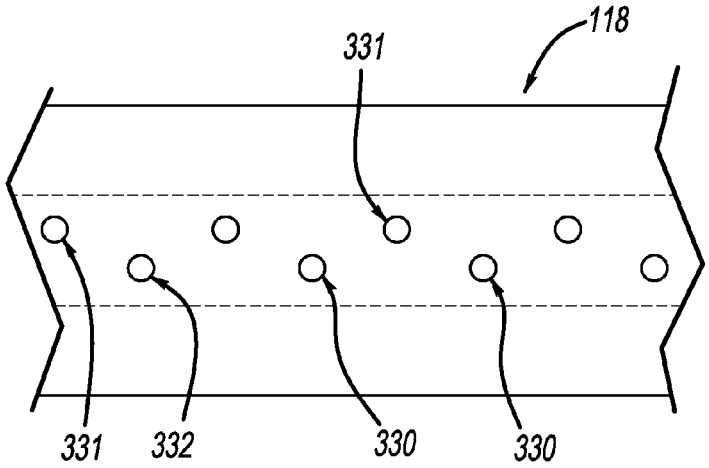
FIG. 6 illustratively depicts a top-down view of the muffler assembly referenced in FIG. 1 or FIG. 4.

Various configurations of the stand-of connector illustratively depicted in FIG. 3A through FIG. 3F may be employed individually or in any suitable combination to attach the muffler shield 110 to the muffler 104. In addition, and as mentioned herein elsewhere, one or more of the connectors illustratively depicted in FIG. 3A through FIG. 3F may be arranged in or on the middle portion 212 of the muffler shield 100 along the longitudinal direction "L" and/or the transverse direction "T." FIG. 6 illustratively depicts a top-down view of the shield body 118 when a number of the threaded fasteners 331 and/or a number of the stand-of connectors 330 or 332 are employed in or on the middle portion 212 of the shield body 118.

Figure 4:
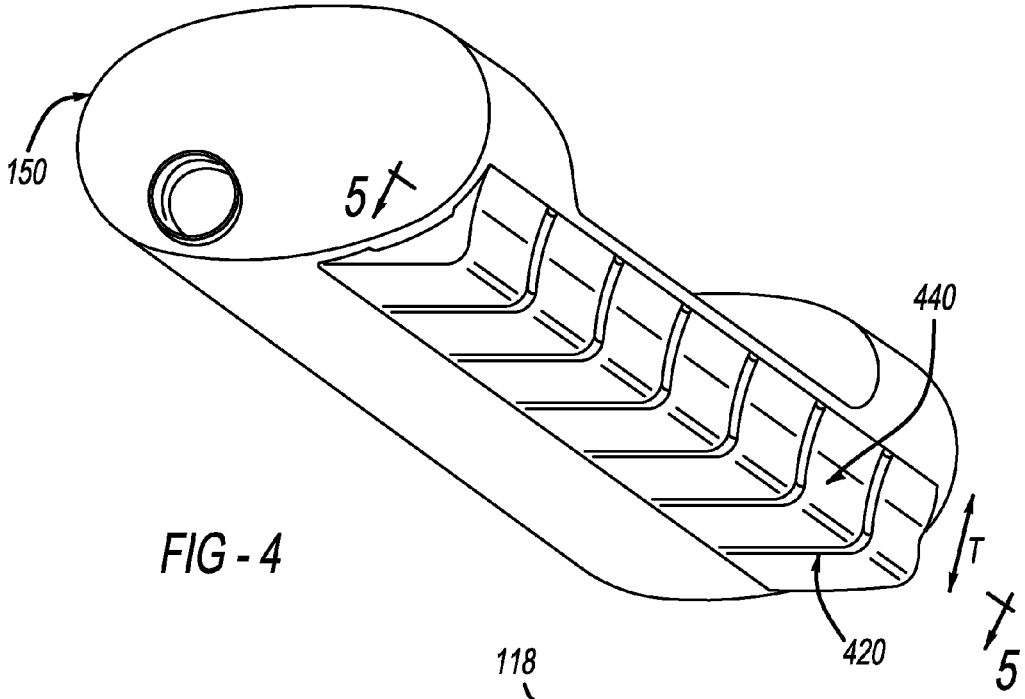
FIG. 4 illustratively depicts a perspective view of a variation to the muffler assembly referenced in FIG. 1.

Optionally, and as illustratively depicted in FIG. 4, one or more grooves 420 may be formed on an exterior surface 440 of the muffler shield 100. The grooves 420 are oriented to lead an incoming air flow so as to further reduce air-induced rattle or turbulence, and/or mechanical vibration-induced rattle. The grooves 420 may be spaced apart from each other with any suitable distance in between. The grooves 420 may be formed as an integral part of the muffler shield 100 and the shield body 118 in particular. Each of the grooves 420 may span at least a part of the width of the shield body 118 along the transverse direction "T."

In one or more embodiments, the present invention as set forth herein is believed to have overcome certain challenges associated with air-induced rattle and/or mechanical vibration-induced rattle in a muffler shield. However, one skilled in the art will readily recognize from such discussion, and from the accompanying drawings and claims that various changes, modifications and variations can be made therein without departing from the true spirit and fair scope of the invention as defined by the following claims.

What is claimed is:

1. A muffler assembly comprising:

a muffler with a longitudinal axis thereof extending along a vehicle-width direction when installed onto a vehicle; and a shield supported on an exterior surface of the muffler and defining a middle portion positioned between first and second side portions along a vehicle-length direction, a cross-section of the middle portion and of at least one of the first and second side portions respectively defining a middle profile and a side profile shorter than the middle profile, wherein the middle profile is a middle linear distance of a middle outer surface of the middle portion at the cross-section away from the exterior surface of the muffler along a direction transverse to the vehicle-length direction, and wherein the side profile is a side linear distance of a side outer surface of the at least one of the first and second side portions at the cross-section away from the exterior surface of the muffler along the direction transverse to the vehicle-length direction, wherein the second side portion is more posteriorly positioned than the first side portion as installed onto the vehicle, and wherein the second side portion is with a greater gap distance away from the exterior surface of the muffler than the first side portion.

2. The muffler assembly of claim 1, further comprising a first end cover positioned between the shield body and the exterior surface of the muffler, the first end cover contacting at least one of the middle portion and the first and second side portions of the shield body.

3. The muffler assembly of claim 2, further comprising a second end cover positioned between the shield body and the exterior surface of the muffler, the second end cover contacting at least one of the middle portion and the first and second side portions of the shield body.

4. The muffler assembly of claim 3, wherein the muffler includes a middle recess positioned between the first and second end covers along the vehicle-width direction.

5. The muffler assembly of claim 1, further comprising a first stand-off connector and a second stand-off connector for connecting the shield body to the muffler, wherein the second stand-off connector is spaced apart from the first stand-off connector along the vehicle-width direction.

6. The muffler assembly of claim 1, wherein the shield is elongated with a length extending along the vehicle-width direction and a width extending along the vehicle-length direction, the width is shorter than the length, when the shield and the muffler are installed onto the vehicle.

7. The muffler assembly of claim 1, wherein the shield further includes an elongated groove extending along the vehicle-length direction.

8. The muffler assembly of claim 1, wherein the shield is positioned at least partially underneath the muffler when the shield and the muffler are installed onto the vehicle.

* * * * *